United States Patent [19]

Berfield et al.

[11] Patent Number: 4,938,421

[45] Date of Patent: Jul. 3, 1990

[54] CLEANING LIQUID MIXER FOR A WATER LINE, PARTICULARLY FOR A SURFACE CLEANER

[75] Inventors: Robert C. Berfield, Jersey Shore; Ronald F. Meland, Muncy, both of Pa.

[73] Assignee: Shop-Vac Corporation, Williamsport, Pa.

[21] Appl. No.: 358,248

[22] Filed: May 26, 1989

Related U.S. Application Data

[63] Continuation-in-part of Ser. No. 289,906, Dec. 23, 1988, abandoned, which is a continuation-in-part of Ser. No. 283,378, Dec. 12, 1988, abandoned.

[51] Int. Cl.[5] ..... B05B 7/32; B05B 9/04

[52] U.S. Cl. ..... 239/309; 239/313; 239/323; 222/82; 222/94; 222/95; 15/321

[58] Field of Search ..... 239/309, 310, 313, 323, 239/327; 222/81, 82, 88, 94, 95, 105, 106, 386.5; 15/320, 321, 322

[56] References Cited

U.S. PATENT DOCUMENTS

| | | | |
|---|---|---|---|
| 967,450 | 8/1910 | Sholes | 239/323 |
| 3,198,438 | 8/1965 | Hultgren | 239/327 |
| 4,019,218 | 4/1977 | Cyphert | 15/322 |
| 4,047,541 | 9/1977 | Mercier et al. | 239/313 |
| 4,156,952 | 6/1979 | Lynch, Jr. | 15/322 |
| 4,218,900 | 8/1980 | Caplan et al. | 15/322 |
| 4,418,869 | 12/1983 | Healy | 239/323 |
| 4,485,518 | 12/1984 | Kasper | 15/322 |
| 4,534,083 | 8/1985 | Hampson | 15/321 |

FOREIGN PATENT DOCUMENTS

| | | | |
|---|---|---|---|
| 2253461 | 5/1973 | Fed. Rep. of Germany | 15/322 |

*Primary Examiner*—Andres Kashnikow
*Assistant Examiner*—Karen B. Merritt
*Attorney, Agent, or Firm*—Ostrolenk, Faber, Gerb & Soffen

[57] ABSTRACT

Apparatus for dispensing mixed water and cleaning liquid to a surface, including a flow regulator connected with the water supply for maintaining flow pressure, a rigid walled capsule which receives water from the flow regulator, a flexible walled liquid detergent container supported in the capsule and a mixer for mixing the water and the liquid detergent. The mixer includes a blade which pierces the previously sealed flexible walled liquid detergent container. A liquid detergent metering passage extends through the piercing blade. A metering pin may seal that passage, define its cross-section and be openable upon that passage being pressurized due to liquid pressure in the capsule. A second water metering passage communicates into the capsule external of the flexible container. Both of the metering passages communicate into a mixing chamber which in turn communicates with the dispensing nozzle for the mixed liquid. A drain connection to the capsule or to the outlet from the mixing chamber. A suction cleaner suctions the dispensed liquid from the surface. The suction cleaner includes a suction inlet next to the dispensing nozzle.

25 Claims, 6 Drawing Sheets

132
130
126
24
20
26
22
34
28
32
29
104
122
76
128
100
30
72
92
77
138
135
137
200
204
202
94
192
188
142
194
186
160
162
184
140
94
180
172
174
176
182
122
110
4
4
130
100
106
104
104
106
122
110
100
102
112

FIG. 6.
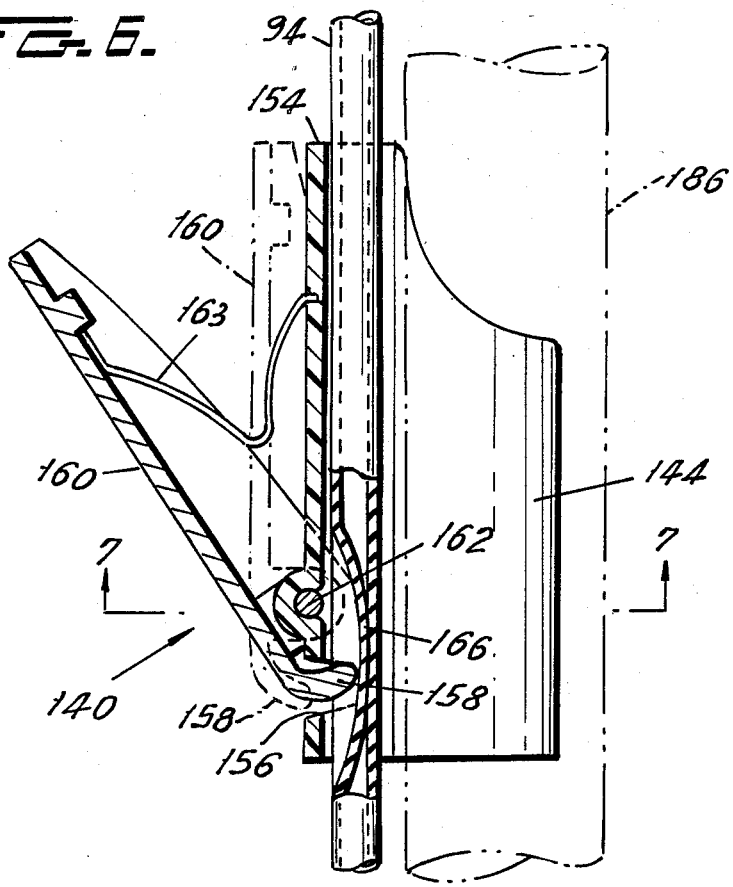
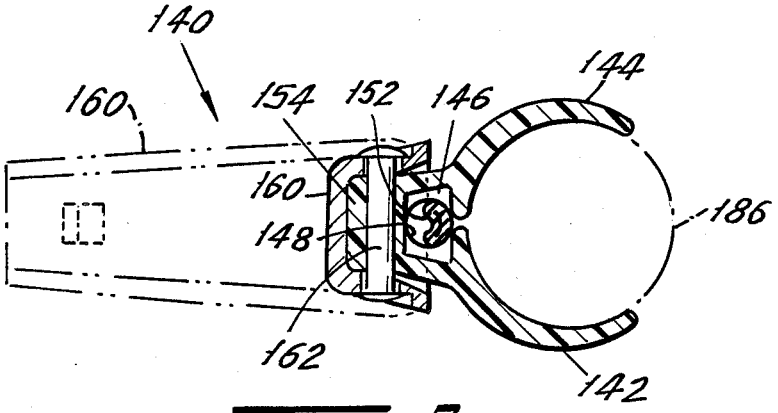
FIG. 7.

FIG. 10
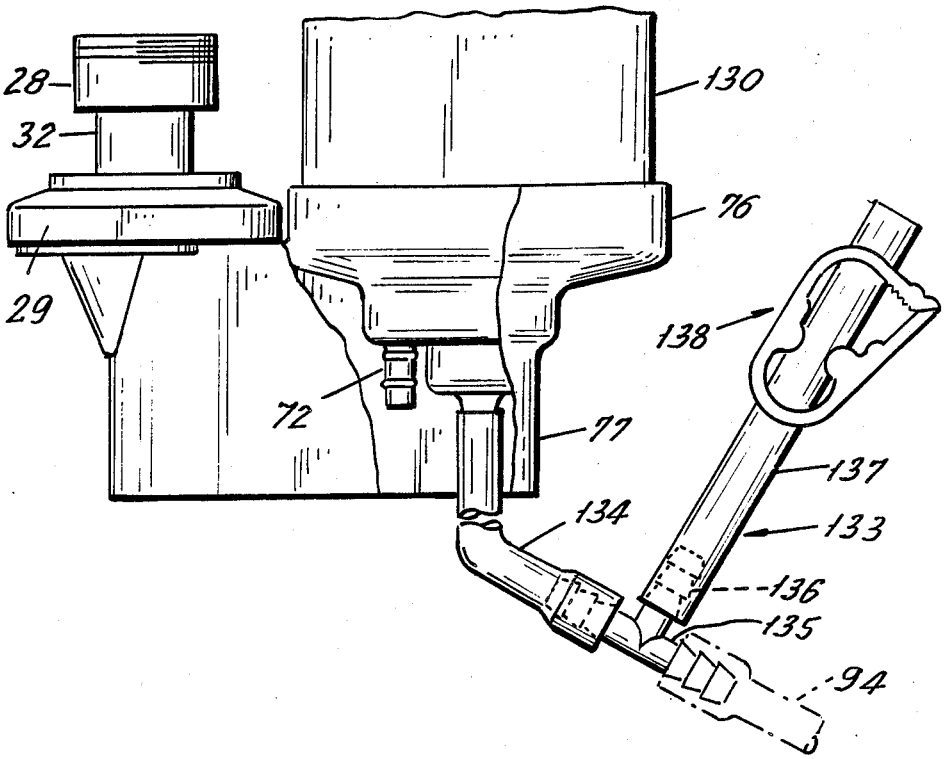
FIG. 11
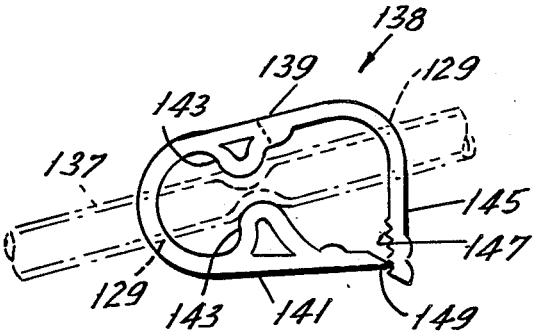
FIG. 13
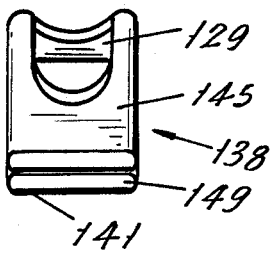
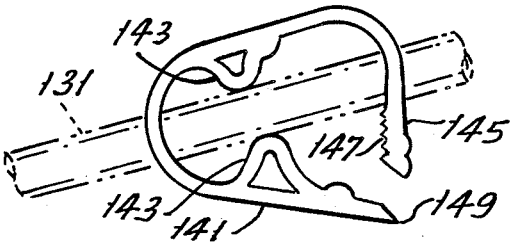
FIG. 12

FIG. 14
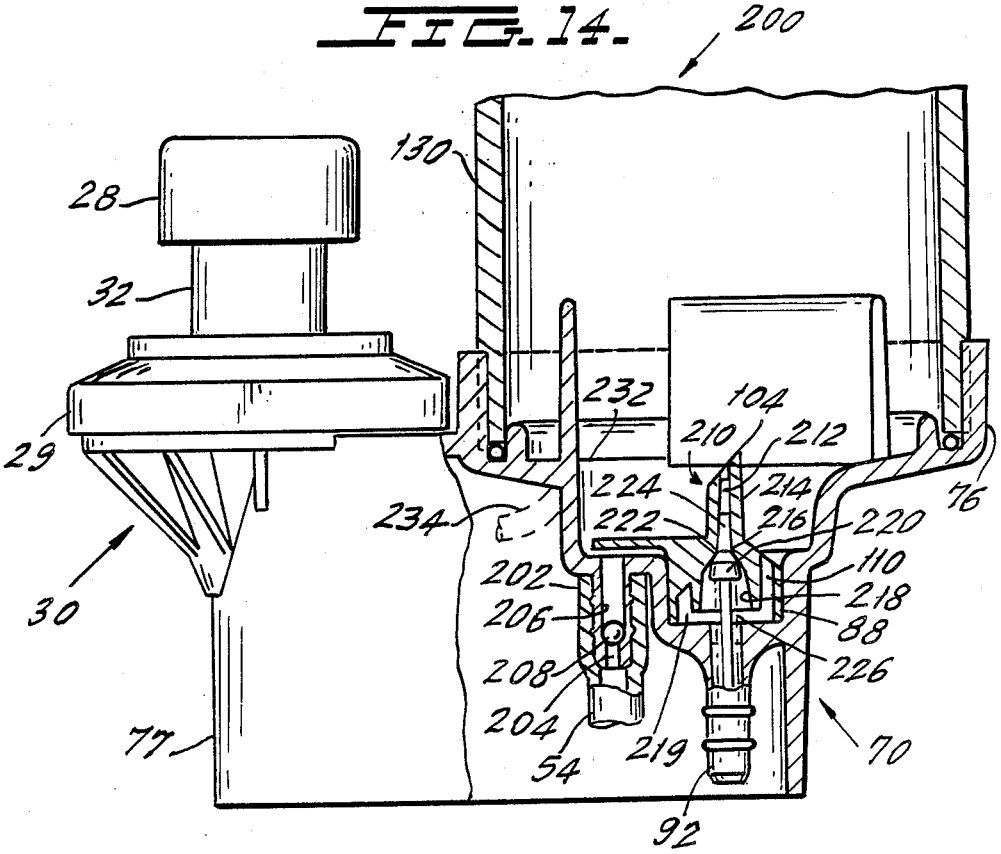
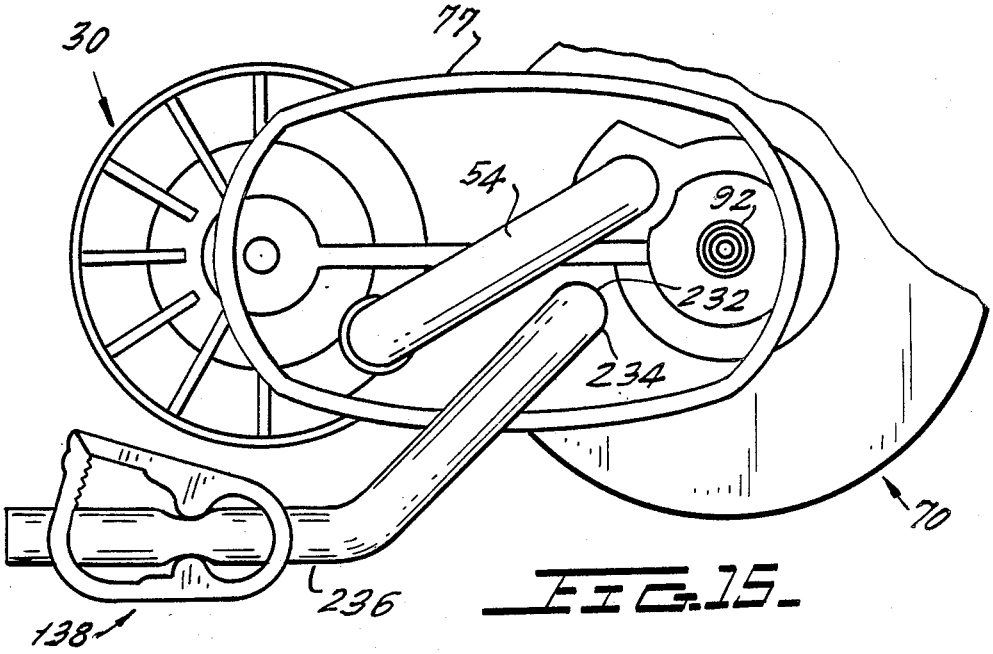
FIG. 15

CLEANING LIQUID MIXER FOR A WATER LINE, PARTICULARLY FOR A SURFACE CLEANER

CROSS REFERENCE TO RELATED APPLICATIONS

This is a continuation-in-part of application Ser. No. 07/289,906, filed Dec. 23, 1988, now abandoned, which is a continuation-in-part of application Ser. No. 07/283,378, filed Dec, 12, 1988, now abandoned.

BACKGROUND OF THE INVENTION

The present invention relates to an apparatus, sometimes described as a carpet extractor, which applies a mixture of water and a cleaning liquid to a carpet, floor or other surface for washing the surface and loosening or dissolving dirt. A separate suction means is associated with the liquid supply. Through a suction nozzle, it suctions the liquid and the loosened or dissolved dirt off the carpet or surface.

Various surface cleaner and carpet extractor arrangements are known, which mix a cleaning liquid with water. They supply the surface cleaning carpet cleaning liquid or shampoo through a dispenser located at a manually operable control valve under the operation of the user. Some of these control valves are placed at the hand held hose or wand that supports both the mixed liquid spraying nozzle and the suction nozzle. Where the cleaning liquid is supplied through a control valve, a venturi arrangement may be used, where the water under pressure passes appropriately shaped passages that meet the water channel to create a venturi effect and suck in the required cleaning liquid.

Another arrangement provides a pre-mixed supply of liquid, consisting of mixed water and detergent. A pump connected with the spray nozzle pumps the premixture to the spray nozzle. Yet another arrangement is in the garden spray type which pumps air under pressure into a tank of premixed water and cleaning liquid, and the liquid is then supplied under pressure.

The above systems are generally high pressure systems, not low pressure systems. This requires better valving, stronger and more expensive tubing, more expensive construction, and the like. A known venturi system could not be used in low pressure operations. It would not usually be possible to develop a sufficiently small orifice at the venturi to avoid back pressure of liquid flow. If the venturi is operable, then the flow of liquid might be insufficient.

Draining and depressurizing prior systems is another problem not adequately addressed. Usually, the user shuts off the standard continuous water supply and then releases the pressure by opening the normal outlet and dispensing valve. This requires either moving the outlet nozzle to a sink or having to clean or suction the extra liquid dispensed during pressure release. Avoidance of this problem is desirable.

Many of these apparatus provide a combination of a liquid supply and delivery means and a portable suction apparatus. The liquid supply means is supported on the suction apparatus. For example, liquid supply is from a tank of the liquid. In some arrangements, the liquid supply is not portable. Instead, there is a main liquid supply, such as a water line, and an elongate dispensing hose for dispensing liquid where it is needed, i.e. to a nozzle near the inlet to the suction apparatus.

The present invention is primarily directed to the latter type of carpet extractor or floor or surface cleaner. That type of cleaner uses a standard suction cleaner, such as a wet/dry pickup cleaner, having a suction nozzle for wet/dry pickup. Near the suction nozzle, there is also a liquid dispenser, and the liquid dispenser is connected by an elongate line to a supply of mixed water and detergent. The supply may be connected with a standard water line and the invention concerns means at the water line for mixing detergent with the liquid moving to the liquid dispenser at the suction nozzle.

Germeshausen, U.S. Pat. No. 3,155,113, shows a device located in a water line for mixing fertilizer in water, so that the combined water and fertilizer mixture may be dispensed. The water pressure in a chamber surrounding a flexible container of liquid fertilizer dispenses the water and the fertilizer into the outlet line in a preset ratio by volume and flow rate which is in part determined by the size of the metering orifices for the water and for the fertilizer. The unit in this patent is generally aligned in the water flow line, and is not offset to the side of the flow line. Further, no concern is taken as to the maintenance of a desired pressure level, that is other than by adjusting the outflow from the water source. Also, no means is disclosed for dealing with a sealed container of fluid to be mixed with the water.

Healy, U.S. Pat. No. 4,418,869 mixes a chemical with water by entraining some of the chemical expelled from a container. This patent does not utilize a flowing fluid, flowing between an outer container and an inner flexible container and then back into the water flow line to dispense from the inner container. Instead, the water under pressure that is disposed between the outer resilient container and the inner flexible container is static. Features relating to the invention that are absent from the Germeshausen patent are not supplied by the Healy patent.

SUMMARY OF THE INVENTION

It is the primary object of the invention to provide predetermined proportioned mixing of a cleaning liquid with water wherein the mixing proportion is independent of the pressure in the water supply line.

Another object of the invention is to enable easy emplacement of a supply of the cleaning liquid that is to be mixed with water into the system and to have the supply of cleaning liquid sealed until its emplacement in the system.

A further object is to ease draining and depressurizing of the system without waste of cleaning liquid.

While the system disclosed herein is described as useful for a carpet cleaner or for a floor or scrub cleaner, it can be adapted for cleaning other items or surfaces, such as upholstery, e.g. by exchanging the dispensing nozzle with another type. Alternatively, the system can be used in any other context where liquid detergent is to be dispensed to a surface and the liquid is to be quite soon after suctioned off the surface.

The apparatus of the invention mixes water and an additional cleaning liquid, detergent or shampoo, or the like and delivers the mixed liquid to a dispenser, for cleaning carpets, or floors or other surfaces. The apparatus includes a water supply arrangement which delivers the water to an inlet to a capsule that is adapted to pass along the water. A flexible walled container is disposed within the capsule so that water pressure in the plenum between the flexible wall of the container and the rigid wall of the capsule around the container presses on the container and expels the detergent or cleaning liquid.

There are metering means communicating with the capsule and having a first water flow metering passage and a second additional cleaning liquid metering passage. The first passage communicates with the capsule while the second passage communicates into the capsule and then into the flexible container. The cross-sections of the first and second passages determine the relative flow rates of water and additional cleaning liquid, regardless of the actual water pressure in the capsule, which may vary. The second passage to the flexible container has a leak preventing spring valve closed seal at its outlet. The first and second passages have respective outlets which communicate into a mixing chamber where the water and additional liquid are mixed. A conduit in the form of a single tube delivers that mixed liquid to a dispensing nozzle at the surface to be cleaned.

The flexible container is preferably initially sealed and is opened at the time that it is placed at the metering means, by an outlet device. The flexible container may first be installed in the capsule. Then a unit comprised of the capsule and the flexible container is installed on the metering means. For this purpose, the flexible container is supported by appropriate support means in the capsule.

The outlet device from the metering means extends into the container. For the outlet device to enter the container, it may be provided with a piercing blade, and the second cleaning liquid transmitting passage may pass through the piercing blade so that when the piercing blade has pierced the flexible container, additional liquid can flow from the flexible container through the second passage past the leak preventing, spring closed, metering valve and to the mixing chamber.

The capsule with the flexible container in it is essentially offset to the side of the metering means and the water flow conduit leading to the capsule, rather than being in a straight line flow path. For that purpose, the inlet to the capsule from the water supply and the metering means are both toward an end of the capsule.

There is a common nozzle housing which houses both the dispensing nozzle for the dispensing of liquid to the surface and a suction nozzle for suctioning the dispensed liquid off the surface. The suction nozzle communicates through a hand held wand and appropriate suction conduit to a standard wet/dry suction cleaner or the like suction device so that the previously dispensed water and detergent with the dirt mixed in it may be suctioned off the surface.

The water supply to the mixing device could be from a standard house water source, e.g. a faucet, which can be turned on and off. The flow from the water source passes through a pressure or flow regulator with means that respond to the pressure of the incoming flow of water to regulate somewhat the flow rate of water to the mixer.

In the event that a user removes the capsule from the mixer without shutting off the water supply, the user could be sprayed with incoming water from the supply. A baffle plate over the mixer inlet blocks that.

The mixer and the outlet tubing from the mixer are filled with liquid. They are preferably drained and depressurized when the water supply is shut off. This is particularly important with the invention because the flexible container of cleaning liquid cannot be removed or replaced until the system is depressurized. In order to drain and depressurize the system, a drain may be connected into the outlet tubing leading away from the mixer. Preferably, however, the drain is connected into the capsule upstream of the outlets from the capsule itself and from the cleaning liquid container therein. Connecting the drain here would avoid loss of cleaning liquid during draining. Wherever the drain conduit is connected, the drain conduit is simply opened, as by its own pinch valve, when the mixer and adjacent tubing are to be drained and depressurized.

A manually operable valve, operable by the user, is in the conduit leading from the outlet from the mixing chamber to the dispensing nozzle so that the user can selectively turn on and off the dispensing of liquid.

Because of the low pressure in the system and the reliance upon water from a commonly available source, e.g. a tap connecting with a domestic water supply, i.e. a water supply at perhaps 20 p.s.i., the invention may use merely a pinch type valve on a single continuous piece of tubing extending from the mixer to the spray nozzle eliminating a valve in the line with seals and eliminating associated connections to thereby provide fewer areas where leakage might be possible.

The pinch type valve allows adjustable placement of that valve anywhere along the tube to suit the user's requirements or preference. This is useful when the valve is used with an upholstery cleaning nozzle as the valve may be placed down at or may be supported on that nozzle. In that context, or also when used with a scrub brush nozzle or a carpet cleaning nozzle, the pinch valve may be placed further up the tubing toward the mixer outlet, again at the user's option.

Other objects and features of the present invention will become apparent from the following description of a preferred embodiment of the invention considered in conjunction with the accompanying drawings.

BRIEF DESCRIPTION OF THE DRAWINGS

FIG. 6 is a view of the mixed water and cleaning liquid dispensing control valve;

FIG. 7 is a bottom view of the control valve of FIG. 6, viewed in cross-section along the line of arrows 7 in FIG. 6;

FIG. 10 is a side view of the region near the mixer showing one embodiment of the mixer and tubing drainage;

FIG. 11 illustrates a closed off drainage line;

FIG. 12 illustrates an opened drainage line;

FIG. 13 is an end view of a clamp for the drainage line;

FIG. 14 is a side cross-sectional view of a second embodiment of a mixer; and

FIG. 15 is a bottom view of the mixer of FIG. 14 along with a pressure regulator.

DESCRIPTION OF THE PREFERRED EMBODIMENT

Figures 1, 4, 5:
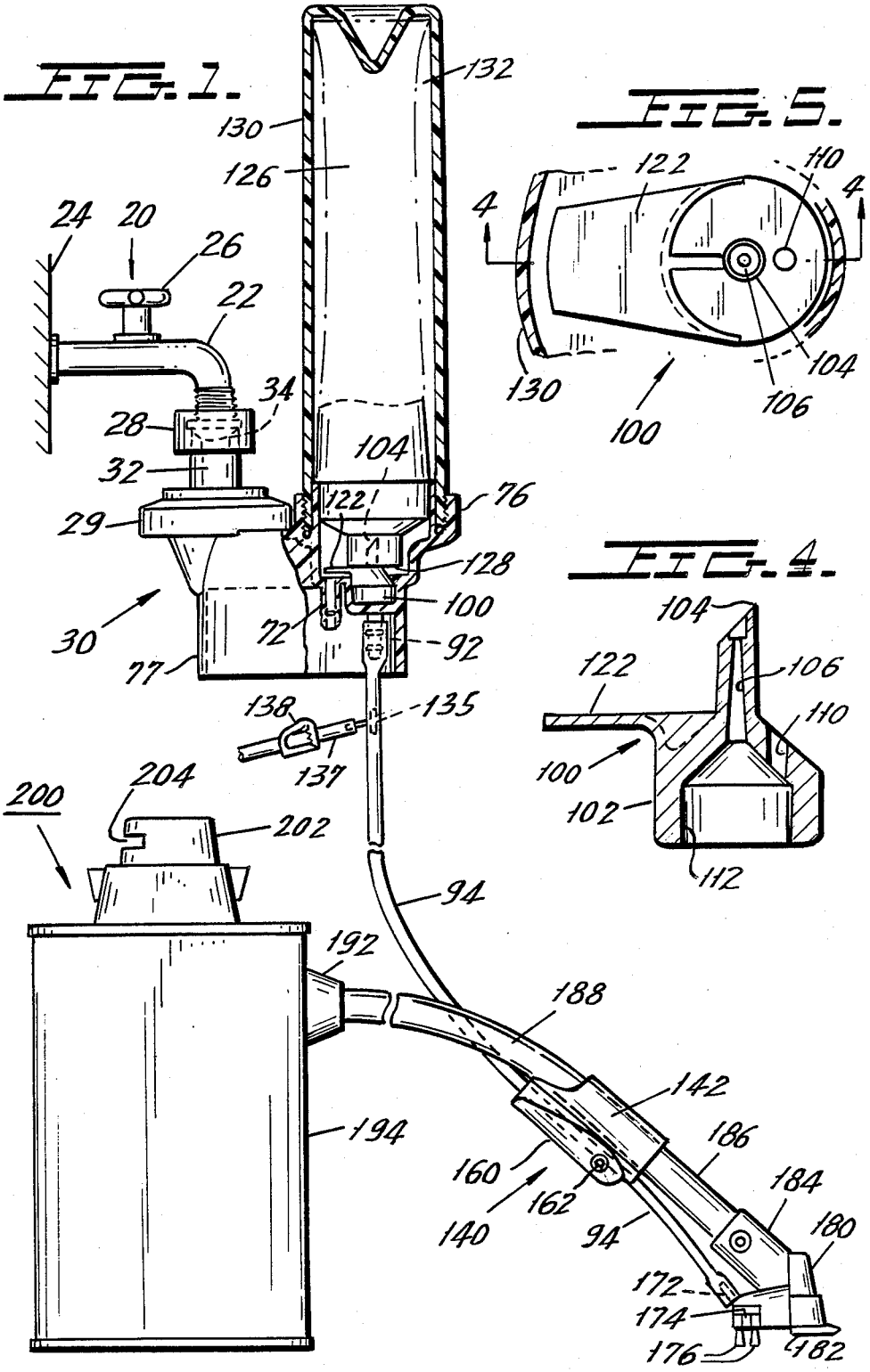
FIG. 1 is a partially cross-sectional view of a mixer according to the invention shown associated with a water supply, a first embodiment of means for dispensing mixed liquid, and means for suctioning and collecting dispensed liquid.
FIG. 4 is a side cross-sectional view of the metering means of FIG. 2 for proportioning the flow of cleaning liquid and water.
FIG. 5 is a top view of the metering means of FIG. 4.

With reference to FIG. 1, the present invention uses water supplied by a standard water supply 20 in a house. It is a water supply of usually variable pressure. The supplied water passes through a water pressure regulator 30 into the mixer 70 according to the invention. From the mixer, the now mixed water and cleaning liquid, mixed in the desired proportion according to the invention, move through the tubing 94 to the dispensing nozzle 174, 180 through which the liquid is delivered to the surface to be cleaned. The dispensing nozzle is housed in a common housing 180 with the suction nozzle 182 and that suction nozzle is coupled to a wand 186 which leads to a hose or tube 188 which communicates with the inlet 192 of a standard wet/dry pickup vacuum cleaner 200.

The conventional water supply 20 comprises a standard water outlet pipe 22 which passes through the wall 24 and is connected with the conventional house water supply (not shown). A standard water valve or faucet 26 dispenses water under the control of the operator. A connecting fitting 28 is attached to the end 32 of the pipe 22 to transmit the water into the pressure regulator 30. Standard house water pressure is typically at a minimum level of 20 psi. The pressure regulator is provided because there are local variations in standard water pressure and the faucet 26 affects water pressure, and the pressure regulator 30 maintains a fairly standard pressure level at the mixer.

Figure 2:
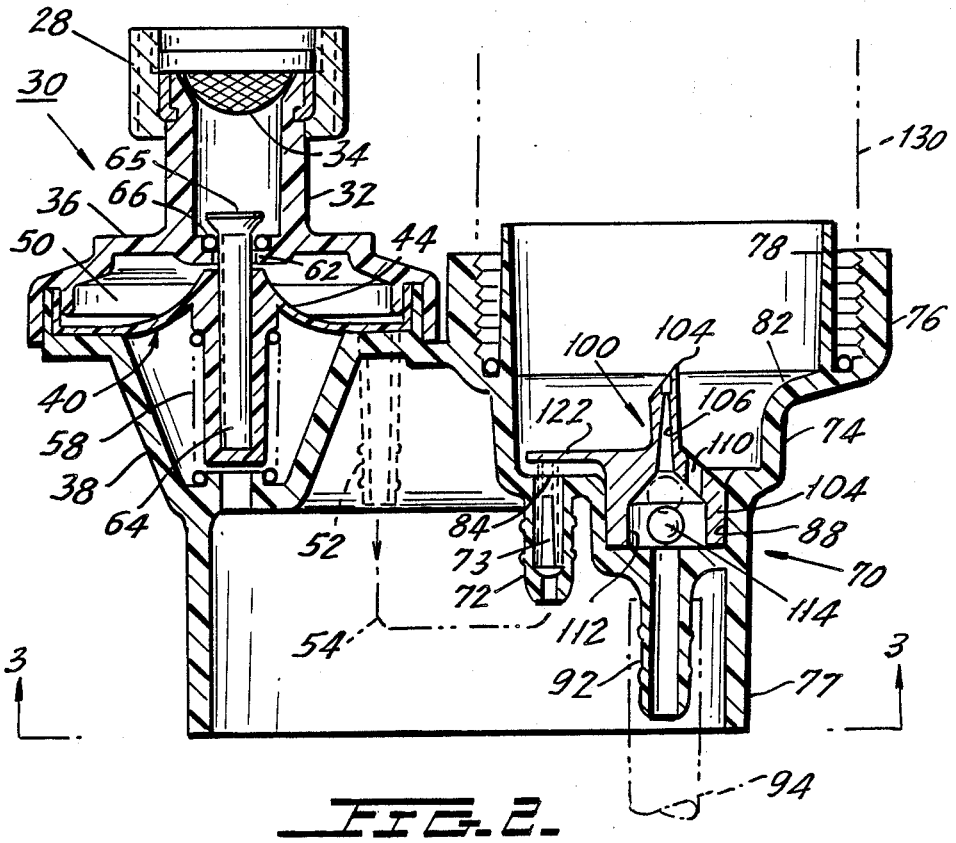
FIG. 2 is a side cross-sectional view of the first embodiment of the mixer and of a pressure regulator shown in FIG. 1.
Figure 3:
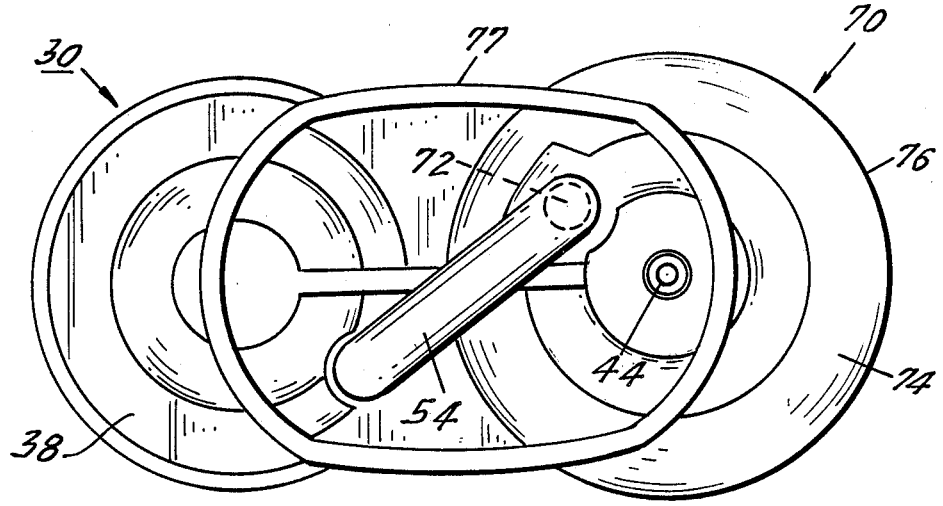
FIG. 3 is a bottom view of the mixer and pressure regulator of FIG. 2 showing the water connection into the mixer unit.
Figure 9:
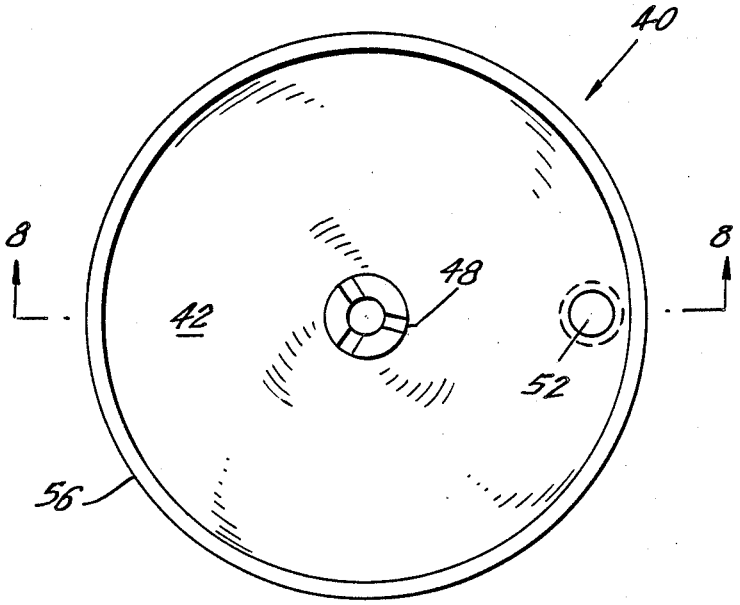
FIG. 9 is a top view of the pressure regulator of FIG. 8.
Figure 8:
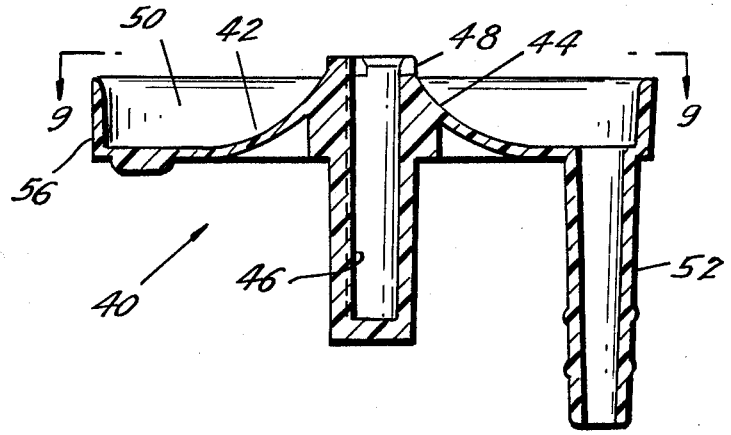
FIG. 8 is a side cross-sectional view of the pressure regulator located at the water supply in FIGS. 1 and 2 for regulating the pressure of the water delivered to the mixer.

With reference to FIGS. 2, 8 and 9, the pressure regulator 30 includes a regulator inlet fitting 32 having a standard basket filter 34 for water entering the inlet. The fitting 32 merges into an upper housing 36 which is affixed to and integrated with a lower housing 38. A circular disk diaphragm 40 is disposed in the open space 50 between the housings 36 and 38. The diaphragm 40 has a main resilient body portion 42 which merges in the upraised central boss 44. The upraised boss 44 has defined within it a closed bottom trigger pin opening 46 which receives a pressure regulating trigger pin 64, described below. At the top of the central boss 44 of the diaphragm 40 are a plurality of narrowed passage openings 48, such that water which impinges upon the top of the diaphragm moves through the passage openings 48 and into the plenum 50 above the diaphragm disk 42. Toward one side of the diaphragm is the outlet nipple 52 which is connectable with connection tubing 54 that leads to the water inlet 72 to the mixer 70. The diaphragm includes a peripheral wall 50 which encloses the plenum chamber 56 and is captured and sealed using a spin welding process at the bottom of the upper housing 36 and at the top of the lower housing 38, thereby preventing leakage of water out of the plenum chamber 50. A compression spring 58 normally biases the diaphragm upwardly toward engagement with the underside of the upper housing 36. The upper housing 36 has an opening 62 at its center large enough for through passage of the trigger pin 64.

A headed trigger pin 64 is disposed in the opening 46 inside the boss 44 of the diaphragm. The trigger pin is of such length that when the spring 58 normally urges the diaphragm up, it moves the trigger pin upward as well. The trigger pin has a widened sealing head 65, and the opening 62 through the bottom of the upper housing 36 is sized so that with the pin 64 moved downwardly, the sealing head 65 closes the opening 62. An O-ring 66 around the opening 62 assures the seal closure of that opening with the head 65 down.

The pin 64 is of such length with respect to the height of the opening 46 that with the diaphragm 40 urged upwardly by the spring 58, there is clearance space beneath the head 65 so that water passing through the fitting 32 may pass through the opening 62 and may pass the openings 48 and move into the plenum 50 above the diaphragm 40, 42. With the water pressure low enough, water freely moves into the plenum chamber 50. As the pressure of the incoming water increases, it can force the trigger pin 64, 65 downward, partially and then finally even fully sealing the entrance into the plenum chamber 50. The movement up and down of the trigger pin 64 shifts the diaphragm and thereby regulates the entry pressure of water into the plenum 50.

Water which has passed through the tubing 54 moves into a first embodiment of the water entrance fitting 72 of the mixer 70, as shown in FIG. 2. That fitting has in it a flow metering passage cross-section adjusting pin 73.

The second embodiment 200 of mixer shown in FIG. 14 has a water entrance fitting 202 that differs from the entrance fitting 72 in FIG. 2. The fitting 202 has a metering entry orifice 204 that permits a fully pressurized entrance flow of water. Orifice 204 merges into the upper section 206 of the passage through the fitting section 206, which is of wider diameter than orifice 204. A check ball 208 sits in the section 206 and is sized with respect to the passage diameter to permit water to flow past the ball but is sized to seat against the exit from the narrow orifice 204 into the widened section 206 when the water pressure into the fitting 202 drops. The check ball valve prevents cleaning liquid or water from being drawn back into the water supply system should a low pressure situation occur in the water supply system as compared with the pressure in the removable cartridge 210 or when the water supply is shut off. Gravity and any reverse flow will drive the ball 208 back to its seat. Normal entrance flow of water through the narrowed orifice 204 lifts the ball from its seat and permits the water to pass into the passage section 206.

Returning to FIG. 2, the mixer 70 has a rigid housing 74, the features of which are disclosed below. A stiff surrounding, lower frame 77 joins the mixer housing 74 and the pressure regulator lower housing 38 into an integral structure. The pressure regulator and the mixer are in liquid flow communication through the tubing 54.

The housing 74 of the mixer 70 includes at its top an internally threaded receptacle 76 of a size sufficient to receive and support an externally threaded removable capsule or cartridge 130 which also holds the supply container 126 of cleaning liquid or detergent, as described below. The threaded receptacle 76 also surrounds and is spaced out from an internal wall 78, which supports the container of cleaning liquid, detergent or shampoo 126, which is positioned at the floor 82 opening of the housing.

The inlet fitting 72 (FIG. 2) or 202 (FIG. 10) of the housing 74 has an inlet entrance 84 that opens upward from the bottom of the housing 74.

Also formed in the bottom of the housing 74 is a receptacle 88 for the below described detergent and water metering valve 100 (FIG. 2) or 210 (FIG. 10). Beneath the receptacle 88 for the valve, the housing 74 ends in an outlet nipple 92 to which the elongate length of tubing 94 leading to the spray nozzle is removably attachable.

The first embodiment of a metering valve 100 is illustrated in FIGS. 2, 4, and 5. It includes a metering valve body 102. The body 102 of the metering valve 100 fills the chamber 88 so that there is no leakage past the metering valve.

At the top of the body 102 is a detergent container outlet fitting and piercing blade 104 for piercing the outlet cover 128 of a detergent container 126 that is supported in the capsule or cartridge 130. The blade 104 is immediately above the outlet metering passage 106 that passes through the housing 102. The cross-section of the passage 106 establishes the flow rate of detergent out of the container 126 under pressure and into the mixing chamber 112 beneath the body 102.

There is a water outlet metering passage 110 through the housing 102 whose cross-section establishes the flow rate of water moving through the valve into the chamber 112. The relationship of the cross-sections between the metering passages 106 and 110 determines the relative flow rates of cleaning liquid or detergent and water and thereby determines the concentration of detergent in the water. The flow rates of detergent and water should remain constant, regardless of pressure variations in the water. Both the detergent exiting through the passage 106 and the water exiting through the passage 110 enter and initially mix in the mixing chamber 112 inside the housing 102. A ball float 114 disposed in the chamber 112 will float up to block the passage 106 when there is insufficient detergent flow through the passage 106, for example, due to a blockage. The ball 114 will prevent undesired backflow of water into the detergent supply.

A second embodiment of a mixer 210 is shown in FIG. 14. The blade 104 communicates with the inlet to a passage 212 through the container piercing body 214. The passage 212 gradually flares wider toward its bottom end 216. Beneath that flare, the passage opens into the top end 218 of the mixing chamber 219 to define a seat at 216 for a metering pin 220.

A metering pin 220 is disposed in the passage 212. It includes a flare beginning at 222 which seats at the seat 216 at the base of the passage 212 and closes the passage 212 until cleaning liquid expelled from the container 126 under pressure due to pressurization of the capsule 130 forces the detergent through the passage 212. The metering pin 220 has a boss 224 that projects into the passage 212, and the cross-section of the boss 224 is slightly smaller than that of the passage 212 in which it is disposed, e.g. a 0.005 inch diameter clearance is thereby obtained quite easily by appropriate shaping of the pin 224 with respect to the cross-section of the passage 212. This provides the necessary clearance to meter the flow of the cleaning liquid.

A compression spring 226 continuously presses between the floor of the chamber 112 and the underside of the bottom of pin 220 to urge the pin upwardly to engage its seat 216, and the spring pressure is selected to let the metering valve 220, 224 open under the water pressure delivered in the capsule 130. When the container of additional liquid is in place, the capsule 130 is filled with water and the capsule is pressurized.

The arrangement just described replaces the above described ball float 114 disposed in the chamber 12 in FIG. 2. The biased pin 220 is believed to be a more reliable arrangement than of the ball float with respect to leakage prevention, as the ball may not provide sufficient resistance against premature dispensing of the cleaning liquid and the metering could not be as precisely controlled by trying to make the bore 212 small enough.

Returning to FIG. 2, projecting from one side of the mixer housing 102 is the baffle plate 122 which overlies but is spaced up from the inlet 84 from the inlet fitting 72 so that water spraying into the mixer housing 74 will strike the baffle plate 122 and not spray into the air, especially if the water supply should be turned on while the capsule 130, described below, is removed from the housing 74. Further, the turbulence of the water spray entering the cartridge 130 is reduced by the baffle plate 122.

The supply of cleaning liquid, detergent or carpet shampoo comprises a flexible container 126 filled with such a liquid. The container is comprised of plastic, or the like, and is similar, for example, to a flexible walled dispensing container for toothpaste or hair shampoo. The flexible container 126 has a normally closed outlet end 128 that retains the detergent in the container until needed.

The flexible container 126 is installed inside a rigid walled cartridge or capsule 130. The container 126 does not fill the interior of the cartridge 130, which leaves a small cross-section, generally annular plenum 132 around the container 126 into which the water under pressure from inlet fitting 72 can travel for pressurizing the container therein. The container 126 may be initially installed in the cartridge 130. Then the combination of the cartridge 130 and the container 126 are installed in the receptacle 76. The interior of the wall 78 is sized so that the bottom end of the container 126 is supported by the interior of the wall 78, although it is not tightly sealed there or there is an open space there to permit water to pass by the container into the plenum 132.

When the cartridge 130 is installed from above in the receptacle 76, the outlet covering 128 of the container 126 is forced down over the blade 104, and the blade 104 pierces the covering 128 and moves sufficiently into the container as to expose the passage 106 (FIG. 2) or 212 (FIG. 14) to the detergent within the container 126. In the first embodiment of FIG. 2, the passage 106 is narrow enough and the detergent within the container 126 is viscous enough that the liquid is not fed from the flexible container 126 until pressure is applied to the container. In the second embodiment of FIG. 14, the pin 220, 222, 224 is lowered from its seal 216 by the pressure of the cleaning liquid forced from the flexible container 126, and the cross-section of the narrowed passageway that develops between the interior of the passage 212 and the exterior of the pin 224 combines with the viscosity of the cleaning liquid in the container 126 to feed a metered amount of the cleaning liquid past the pin 220 and into the mixing chamber 112.

As water enters the inlet fitting 72 or 202 under pressure and after it passes the baffle 122, the water fills the plenum 132 around the container 126 and raises the pressure in the plenum 132 to the pressure of the incoming water. This simultaneously applies pressure to the exterior of the flexible container 126 so that the cleaning liquid inside the container 126 is also at the pressure of the water in the plenum 132. The water exits from the plenum 132 through the outlet passage 110 while the detergent in the container 126 exits from that container through the passage 106 (FIG. 2) on the passage 212 (FIG. 14). The water and detergent mix in the chamber 112 or 219 and are dispensed together through the outlet nipple 92. The liquid mixture passes through the tube 94 which extends toward the conventional floor nozzle 174, described below, at which the mixture is dispensed.

Referring to FIGS. 1 and 10, a first embodiment of a drain system from the mixing chamber is disclosed. Downstream of the outlet nipple 92 and preferably upstream of the below described control valve 140, the first embodiment of a drain system 133 from the tube 94 is shown. After the water from source 26 has been turned off, the mixer 100 and the section 134 of the tube 94 above the drain 133 are filled with liquid. The liquid is preferably to be drained. Joining the adjacent ends of the tubing section 134 and the tube 94 is a T-fitting 135 having a branch 136 that is received in a drain tube 137 through which the mixer 100 and the tubing section 134 are drained. Tube 137 may drain into a sink or a receptacle.

A second embodiment of drain arrangement is shown in FIGS. 14 and 15. In the embodiment of FIG. 10, the draining takes place downstream of the mixing of water and the cleaning liquid or detergent and after they have been mixed and metered. Therefore, the draining at that point wastes any of the cleaning liquid that is in the mixing chamber 112 or the conduit 92 afterwards and that moves out during the draining stage.

The second embodiment shown in FIGS. 14 and 15 improves over the first embodiment since in the second embodiment the draining is out of the capsule 130 and is therefore upstream in liquid flow before the passage 106 or 212 and before the mixing of cleaning liquid or detergent with the water for preventing waste of the cleaning liquid. As shown in FIG. 15, there is an additional outlet 232 at the bottom of the capsule 130, which leads into the conduit 234. That conduit is flexible, at least at 236, for being pinched off, as described below. As soon as the water supply 20 is shut off, pressurization of container 130 is halted and the water in that container settles to the bottom of the container and drains through the drain outlet 232 at the bottom and into the conduit 234, 236.

During operation, depressurizing and draining should be avoided. For this purpose, the tubing 137 (FIG. 10) or 236 (FIG. 15) carries a respective pinch clamp 138. The top and the bottom of the clamp 138 have openings 129 through them and the tube 137 or 236 passes through the openings to keep the clamp on the tube.

Referring to FIGS. 11 and 12, the arms 139, 141 of clamp 138 are normally self biased apart, as in FIG. 12, which opens tube 137 or 236. When those arms are pinched together, the pressure ridges 143 on their insides clamp against and occlude tube 137 or 236, as in FIG. 11, blocking drainage. The normally self biased open arms 139, 141 must be locked into their position of FIG. 11. The top arm 145 has a toothed rack 147 on its underside which cooperates with the point 149 on the end of the arm 141 to lock the arms 139, 141 in a clamping position when they are squeezed together. The clamping is simply released by the user raising the top arm 145, which permits the arms 139, 141 to spring apart.

When liquid is to be dispensed, not halted, the mixed liquid next passes the control valve 140 which is manually operable to selectively stop and start the flow of mixed liquid. Therefore, the liquid flow is controllable either at the manually operable faucet valve 26 or at the control valve 140.

The control valve 140 shown in FIGS. 6 and 7 is a pinch valve which can pinch the tube 94. Around the below described stiff tubular wand 186 of the suction hose, there is a two armed support bracket 142, 144, whose arms meet at the junction and support fitting 146. The opening 148 in the fitting 146 receive the ends of the arms 142, 144 of the bracket and permits them to be moved apart, while the arms are normally self-biased together, e.g. by resilient material 152 in the opening 148. Other means may be provided for separably clamping the bracket arms 142, 144 to the wand. The bracket 142, 144 includes a guide and support 154 for the flexible tube 94 which delivers the mixed liquid to the dispensing nozzle. The side wall of the support 154 is open at 156 to permit the entry of the pinch tip 158 of the pinch lever 160. The lever 160 is supported at the pivot 162, which is also on the bracket 154. A leaf spring 163 extends between the lever 160 and the support 154 and normally biases the lever to pivot outwardly, into its solid line orientation in FIG. 6. With the lever 160 in the solid line, outwardly tilted position shown in FIG. 6, the pinch tip 158 pinches the tube 94 at 166 and blocks the flow of mixed liquid to the dispensing nozzle. With the lever 160 pivoted to the broken line position in FIG. 6, the pinch tip 158 is out of engagement with the tube 94, the tube resiliently self-biases itself open and liquid may flow to the outlet nozzle.

Returning to FIG. 1, below the control valve 140, the tube 94 continues to the fitting nipple 172 and from there communicates into the outlet 174 which has scrubbing brushes 176 associated with it on a nozzle 180. There liquid is delivered to the surface or carpet to be cleaned. Upon the nozzle 180 and wand 186 being moved back and forth, the brushes 176 clean the surface. The outlet opening 174 and brushes 176 are part of a complete nozzle 180. At the front of the nozzle 180, there is a suction inlet 182 which is forward of the outlet opening 174 and the brushes 176. The suction nozzle inlet 182 communicates through the nozzle suction fitting 184 into the stiff tubular wand 186. That wand in turn communicates into the more flexible tube 188 which leads into the suction inlet fitting 192, the suction device tank 194.

The suction device 200 may be a conventional wet/dry electric vacuum cleaner, for example, which includes the wet material collection tank 194, the blower motor 202 having a fan which communicates into the tank 194 for creating suction therefrom and having an outlet 204 for exhaustion of suctioned air. The liquid drawn into the tank through the narrowed tube 188 and narrowed fitting 192 falls to the bottom of the tank 194 while the air is exhausted through the outlet 204.

To use the above described apparatus, the user connects and installs all of the elements as shown in FIG. 1 with the detergent cartridge 130 in place. The user then turns on the faucet 26 causing water to flow into the cartridge 130. The flowing water mixes with the detergent that is expelled from the flexible container 126 and the mixed liquid passes into the tube 94. Depending upon whether the user wants liquid dispensed during operation of the unit, the operator operates the control valve 140 to selectively permit or prohibit the flow of liquid. The user holds the wand 186 and moves it back and forth over the surface. With the control valve opened, liquid is delivered to the surface, and movement of the nozzle 180 back and forth cleans the surface. The suction source 200 is operated to suck liquid and materials through the nozzle 182 so that as the nozzle 180 is moved back and forth, the previously dispensed liquid is suctioned into the tank 194 for collection.

Although the present invention has been described in connection with preferred embodiments, many other variations and modifications will now become apparent to those skilled in the art. It is preferred, therefore, that the present invention be limited not by the specific disclosure herein, but only by the appended claims.

What is claimed is:

1. Apparatus for mixing water and an additional cleaning liquid and for delivering the mixed liquid to a dispenser thereof, comprising:

a water supply conduit;

a pressure application capsule, the capsule having an inlet and the water supply conduit communicating with the capsule inlet for delivering water into the capsule; a flexible container containing an additional liquid to be mixed with the water, the container having flexible walls, the container being disposed in the capsule, the capsule and container being so shaped as to provide a plenum in the capsule around the flexible container:

metering means communicating with the capsule comprising a metering valve body having a first water flow metering passage therethrough for communicating from the inside of the capsule to a first outlet outside of the capsule; the body having a second metering passage for the additional liquid; the second metering passage communicating from inside the container to a second outlet outside of the capsule; the cross-sections of the first and the second metering passages are selected that the same pressure applied to the container of additional liquid and to the water in the capsule, the water will flow through the first metering passage at a flow rate in a predetermined ratio to the flow rate of the additional liquid through the second metering passage;

a mixing chamber into which the first and the second metering passage outlets communicate for enabling the mixing of the additional liquid and water in the chamber, and a third outlet from the chamber;

a dispensing nozzle for dispensing mixed liquid to a surface to be cleaned and a conduit joining the third outlet from the chamber to the dispensing nozzle for delivering liquid thereto.

2. The apparatus of claim 1, further comprising suction means having a suction inlet spaced from the dispensing nozzle such that liquid dispensed through the dispensing nozzle may be suctioned up from the surface by the suction means through the suction inlet.

3. The apparatus of claim 2, further comprising a common nozzle housing in which the dispensing nozzle is disposed and the suction inlet is spaced from the dispensing nozzle in the common nozzle housing.

4. The apparatus of claim 1, wherein the container is initially sealed and the metering means includes a container outlet device at the second passage, placed and shaped such that mounting the container at the second passage involves pushing the outlet device into the container for gaining access to the interior of the previously sealed container.

5. The apparatus of claim 4, wherein the container is supported within the capsule and the container is shaped for defining a plenum around the container inside the capsule;

mounting means for the capsule located at the metering means; the metering means being so placed that upon mounting of the capsule at the metering means, the flexible container is positioned for the outlet device to enter the flexible container for opening communication between the interior of the container and the second passage.

6. The apparatus of claim 5, wherein the metering means outlet device comprises a piercing blade projecting from the metering means being of such length and so positioned as to pierce the container supported within the capsule, the second passage extending through the projecting piercing blade; the first passage communicating through the metering means; and the mixing chamber being disposed in the metering means.

7. The apparatus of claim 6, further comprising the metering means including a housing having a receptacle defined in it and the capsule being attached in the housing receptacle; the metering means being disposed in the housing and the piercing means extending up into the interior of the receptacle.

8. The apparatus of claim 7, further comprising the inlet to the capsule being defined in the receptacle to which the capsule is attached; a baffle in the housing over the inlet into the housing from the water supply conduit for redirecting the water flow.

9. The apparatus of claim 5, wherein the metering means second passage communicates from the flexible container to the mixing chamber and has a first cross-section; a metering pin of smaller cross-section than the first cross-section which is disposed in the second passage, for defining a cross-section for the second passage that is the difference between the cross-section of the second passage and the cross-section of the metering pin;

a seat in the second passage for the metering pin, and the metering pin being so shaped with respect to the seat that upon the metering pin being seated against the seat, the metering pin seals the second passage;

means biasing the metering pin to the seat and the metering pin and seat and biasing means being so placed that elevated pressure in the flexible container moves material out of the flexible container at sufficient pressure to move the metering pin against the bias of the biasing means off the seat for opening the second passage for flow of material from the flexible container through the second passage.

10. The apparatus of claim 1, wherein the capsule is of rigid material while the container is of flexible material.

11. The apparatus of claim 1, wherein the conduit from the outlet of the mixing chamber to the dispensing nozzle includes a pinchable tube;

the apparatus further comprising a manually operable valve on the pinchable tube between the outlet from the mixing chamber and the dispensing nozzle for being selectively opened and closed for selectively permitting and prohibiting the flow of liquid to the dispensing nozzle.

12. The apparatus of claim 11, further comprising a drain conduit connected into the pinchable tube and means for selectively opening and closing the drain connection.

13. The apparatus of claim 12, further comprising a drain connection to the conduit from the outlet and means for selectively opening and closing the drain connection.

14. The apparatus of claim 1, further comprising a manually operable valve at the conduit from the outlet to the dispensing nozzle for being selectively opened and closed for selectively permitting and prohibiting the flow of liquid to the dispensing nozzle.

15. The apparatus of claim 1, further comprising a drain connection to the conduit from the outlet and means for selectively opening and closing the drain connection.

16. The apparatus of claim 15, wherein the drain connection comprises a clampable tube and the means for selectively opening and closing the drain connection comprising a clamp for selectively clamping the clampable tube.

17. The apparatus of claim 1, further comprising a drain connection to the capsule for draining water from the capsule and for eliminating water pressure in the capsule and upon the flexible container in the capsule.

18. The apparatus of claim 17, wherein the capsule has a bottom and the drain connection to the capsule is at the bottom of the capsule.

19. The apparatus of claim 17, further comprising means for selectively opening and closing the drain connection.

20. The apparatus of claim 19, wherein the drain connection comprises an outlet from the capsule and a pinchable tube extending away from the outlet, and the means for selectively opening and closing the drain connection comprises a clamp for selectively clamping the clampable tube.

21. The apparatus of claim 1, further comprising a flow regulator disposed in the water supply conduit to the capsule and including means for regulating the pressure of the water flow into the capsule.

22. The apparatus of claim 5, wherein the capsule has an end at which the capsule inlet is located; the metering means being at the same end of the capsule as the capsule inlet.

23. The apparatus of claim 22, further comprising the metering means including a housing having a receptacle defined in it and the capsule being attached in the housing receptacle; the metering means being disposed in the housing and the opening device extending up into the interior of the receptacle.

24. The apparatus of claim 23, further comprising the inlet to the capsule being defined in the receptacle to which the capsule is attached; a baffle in the housing over the inlet into the housing from the water supply conduit for redirecting the water flow.

25. The apparatus of claim 1, wherein the capsule inlet includes therein a check valve for permitting water flow only into the capsule and for prohibiting return flow out of the capsule through the capsule inlet.

* * * * *